United States Patent [19]

Fujii

[11] 4,402,149

[45] Sep. 6, 1983

[54] IMPACT GUARD FOR DECLUTCHING SNOW THROWER

[76] Inventor: Tuneo Fujii, No. 285, Oaza-Koike, Tsubame-shi, Niigata-ken, Japan

[21] Appl. No.: 413,261

[22] Filed: Aug. 31, 1982

[30] Foreign Application Priority Data

Apr. 10, 1982 [JP] Japan ..... 57-52212[U]

[51] Int. Cl.[3] ..... E01H 5/09; F16D 19/00

[52] U.S. Cl. ..... 37/245; 74/97; 192/99 R

[58] Field of Search ..... 37/245; 192/83, 99 R, 192/99 A, 99 B, 99 S, 89 R, 89 QT; 74/97

[56] References Cited

U.S. PATENT DOCUMENTS

| | | | |
|---|---|---|---|
| 4,026,392 | 5/1977 | Hirschkoff | 192/89 R |
| 4,062,135 | 12/1977 | Rudolph | 37/245 |
| 4,204,591 | 5/1980 | Tawi et al. | 192/99 R |
| 4,255,879 | 3/1981 | Greider | 37/245 |
| 4,324,324 | 4/1982 | Priepke et al. | 192/89 QT |

FOREIGN PATENT DOCUMENTS

| | | | |
|---|---|---|---|
| 704129 | 2/1965 | Canada | 192/99 R |
| 944050 | 6/1956 | Fed. Rep. of Germany | 192/83 |
| 2393979 | 2/1979 | France | 192/99 A |

*Primary Examiner*—E. H. Eickholt
*Attorney, Agent, or Firm*—Koda and Androlia

[57] ABSTRACT

A snow plow including an automotive car body equipped with an engine, a transmission and a clutch means; an operation-frame attached to the rear upper portion of said car body; a clutch operation means attached to said operation frame, said clutch operation means being designed to operate for disengaging said clutch means; and a snow plow apparatus mounted on the car body, wherein said operation frame is provided with an upper guard frame having a substantially same width as the car body with freedom of oscillation; the car body is provided, under said upper guard frame, with a lower guard frame having a substantially same width as the car body with freedom of oscillation; said both guard frames are connected by means of a first connecting means; and any one of both guard frames is connected with the clutch operation means by means of a second connecting means so that when an impact is applied on either guard frame the clutch operation means is designed to operate for disengaging the clutch means.

3 Claims, 3 Drawing Figures

IMPACT GUARD FOR DECLUTCHING SNOW THROWER

BACKGROUND OF THE INVENTION

This invention relates to a guard apparatus that is capable of protecting the operator safely from dangers liable to occur when a small type snow plow retreats.

As the small type snow plows of this sort there are well known those including a self-driving car body equipped with an engine, a transmission and a clutch means; an operation frame attached to the rear upper portion of said car body; a clutch operation means attached to said operation frame, said clutch operation means being designed to operate for engaging or disengaging said clutch means; and further a snow plow apparatus mounted on the car body, and devised so that the snow removal is effected while the operator engages or disengages the clutch means by getting said operation frame into operation and advances or retreats the snow plows at a desired speed by switching the transmission.

However, the above mentioned small type snow plows involve various dangers peculiar thereto, for instance, that when removing the snow using the small type snow plow of this sort, the operator is very likely to tumble off due to hard uneven surface conditions at the work spot and especially when the snow plow is retreating, is run over by it and injured; that apart from this, when the operator retreats the snow plow without noticing the presence of obstacles such as snow wall, trees, fences and the like there is possibility of him being caught between the snow plow and obstacles and injured; and further that when the operator, due to his unskilled operation, retreats the snow plow by mistake in spite of advancing it there is possibility of him being injured by contacting the obstacle.

In view of the above situation, it has long been proposed seriously to provide a snow plow that can dissolve the above enumerated problems effectively. However, the fact is that such a snow plow has not been achieved up to now.

SUMMARY OF THE INVENTION

It is an object of this invention to provide a guard apparatus for use in the small type snow plow that can solve the inherent problems in the usual small type snow plow, can protect the operator safely from dangers to be caused by its retreat movement and further is simple in structure as well as easy to manufacture.

The above object of this invention can be achieved by the provision of a snow plow including a self-driving car body; an operation frame attached to said car body; an upper guard frame having a substantially same width as the car body attached to said operation frame with freedom of rearward oscillation; and a lower guard frame having a substantially same width as the car body attached, under said upper guard frame, to the car body with freedom of oscillation, wherein these both guard frames are connected by means of a first connecting means as well as any one of both guard frames is connected with the clutch operation means by means of a second connecting means so that when an impact is applied on any one of both guard frames the clutch operation means is designed to operate for disengaging the travelling clutch.

DETAILED DESCRIPTION OF THE INVENTION

Figure 1:
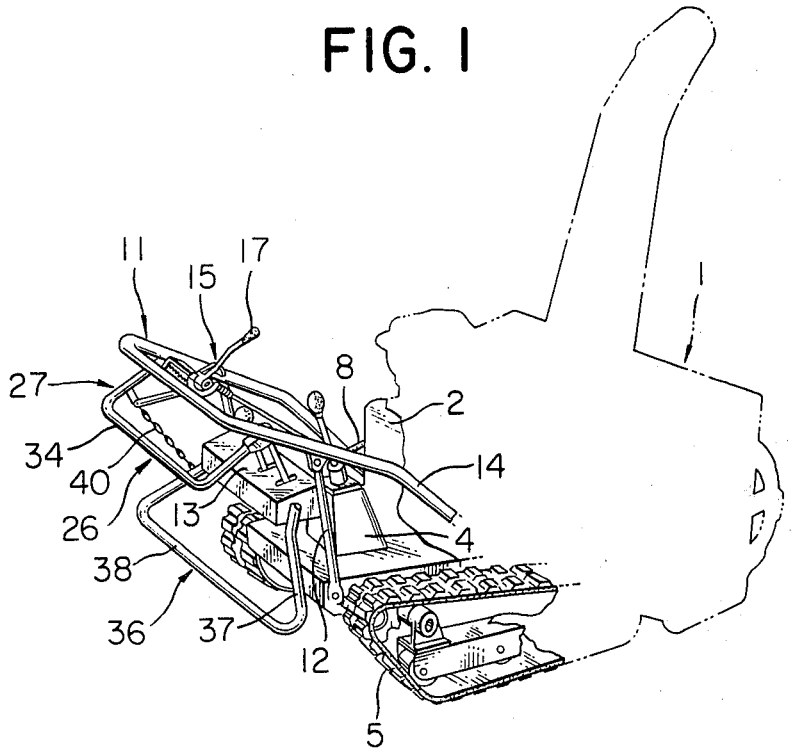
FIG. 1 is a slant view illustrating part of the snow plow equipped with the guard apparatus according to this invention with a solid line and illustrating the other portion thereof with a chain line.

Reference numeral 1 denotes a snow plow including a car body equipped with an engine 2, a snow removing apparatus (not shown) and the like. Power is transmitted from the engine 2 through a clutch means 3 to a transmission 4. Said power is then transmitted to a crawler 5 for advancing (rightwards in FIG. 3) or retreating (leftwards in FIG. 3) the snow plow at a desired speed.

The clutch means 3 includes a driving pulley 6 attached to a driving shaft of the engine, a driven pulley 7 attached to a working shaft of the transmission 4, a belt 8 put around these pulleys, and a tension pulley 10 that is attached rotatably to the fore end of a clutch lever 9 attached with freedom of oscillation to the car body as well as is designed to abut on the belt 8.

An operation frame 11 is fixed in the manner of projecting rearwards to the rear upper part of the car body, said operation frame 11 comprising a pair of longitudinal rods 14 having a substantially same width as the car body and extending rearwards and a transverse rod connecting said longitudinal rods 14 at their rear ends. Between a pair of posts 12 supporting the operation frame 11 there is provided an operation box 13 equipped with various operation levers.

Near the rear end of one longitudinal rod 14 of the operation frame 11 there is provided a clutch operation means 15. This clutch operation means 15 has a shaft 16 fixed to the longitudinal rod 14. The boss part of an operation handle 17 is pivotally fitted on this shaft 16. This boss part is provided with a projecting lever 19 at the place substantially symmetrical against the handle 17. To the fore end of this lever 19 there is attached the rear end of a curved rod 18 that goes substantially half round the boss part. The fore end of this curved rod 18 is connected with the clutch lever 9 through a spring 20 and a rod 21. In this instance, a flexible connecting means such as chain, rope or wire may be employed in place of the rod 21. In the case of using such a flexible connecting means, it is necessary to bias the clutch lever 9 beforehand so that it may always oscillate in the clockwise direction. The longitudinal rod 14 is provided with a stopper 22 that functions to abut on the lever 19 having shifted to the ascending position (illustrated with a solid line in FIG. 3) or the operation handle 17 having shifted to the upright position (illustrated with a chain line in FIG. 3) so as to stop their shifting motion.

The fore ends of a pair of longitudinal rods 27 of an upper guard frame 26 are attached with freedom of oscillation and rearwards to brackets 25 provided perpendicularly near the rear ends of longitudinal rods 14 of the operation frame 11, while the rear ends of longitudinal rods 27 are connected by means of a transverse rod 34. One end of a connnecting rod 29 is pivotally connected to the lower end of a stay 28 mounted perpendicularly on one longitudinal rod 27 of the guard frame 26, and the other end of said connecting rod 29 is pivotally connected to one end of a release lever 30. The other end of this release lever 30 is fixed to a sleeve 31 fitted pivotally on the shaft 16. This sleeve 31 is provided with a projecting push lever 32 on the side opposite to the lever 30. And, a spring 33 is disposed between the lever 30 and the bracket 25.

Fore ends of a pair of longitudinal rods 37 of a lower guard frame 36 are attached with freedom of oscillation to both sides of the operation box 13, and rear ends of the longitudinal rods 37 are connected by means of a transverse rod 38, and, one longitudinal rod 37 and the connecting rod 29 are connected by means of a chain 40. In this instance, the chain 40 may be replaced by a rope, a wire or a rod.

Operation

Figure 2:
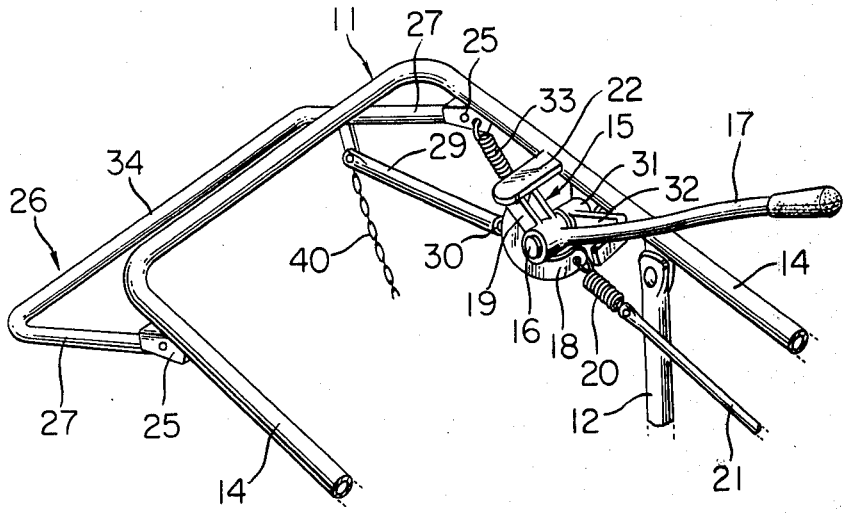
FIG. 2 is an enlarged side view mainly of the solid-lined portion of FIG. 1.
Figure 3:
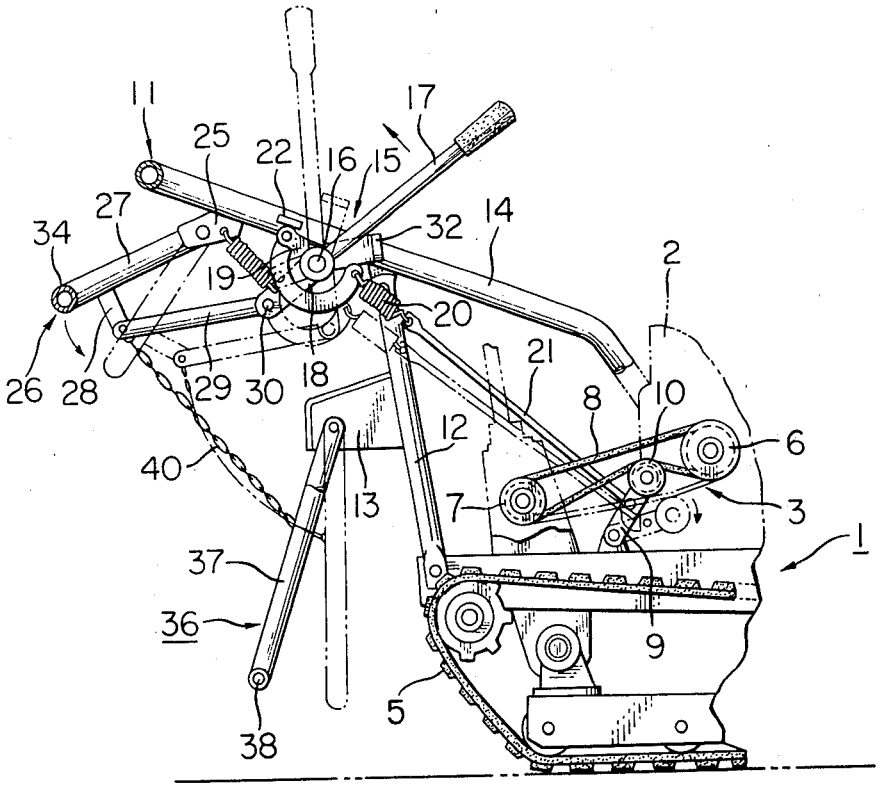
FIG. 3 is a slant view of the main part of the guard apparatus according to this invention.

The state of the above snow plow in snow removing operation is shown in FIG. 3 with a solid line. The operation handle 17 is tilted forward for pulling the rod 21 up through the curved rod 18. The clutch lever 9 is oscillated in the counterclockwise direction to thereby apply tension onto the belt 8 and engage the clutch means 3. Thus, the power of engine 2 is transmitted to the transmission 4. The operator handles operation frame 11 for advancing or retreating the snow plow 1 in desired direction, during which the snow removing operation is effected by means of a snow removing apparatus. In this case, the spring 20 takes the upper position to thereby let the operation handle 17 have a tendency to tilt forward. This tendency is placed under restriction by engagement of the lever 19 with the stopper 22 as illustrated in FIG. 2. And, this restricted state is maintained as it stands.

When discontinuing the snow removing operation as described above, the operator erects the operation handle 17 toward the position illustrated in FIG. 3 with a chain line. Erecting of the operation handle 17 like this acts to push the rod 21 down through the curved rods 18, oscillate the clutch lever 9 in the clockwise direction, and remove the tension from the belt 8 for disengaging the clutch means, whereby the transmission between the engine 2 and the transmission 4 is released. In this case, the spring 20 transfers to the lower position, and in contrast with the previous case, acts to let the operation handle 17 have a tendency to tilt backward. This tendency is placed under restriction by abutment of the operation handle 17 on one side of the stopper 22. And, this restricted state is maintained as it stands.

If the operator tumbles off, is hampered to retreat by obstacles or retreats the snow plow by mistake in spite of advancing it when effecting the snow removing operation while retreating as aforesaid, he will collide against the upper guard frame 26 or lower guard frame 36 located at the place illustrated in FIG. 3 with a solid line.

First, explanation will be made on the case where the operator dashed against the upper guard frame 26 (mainly, the transverse rod 34). As the result of this collision, the guard frame 26 oscillates counterclockwisely around the pivotal point of the bracket 25 and shifts up to the place illustrated in FIG. 3 with a chain line. This shift leads to that the connecting rod 29 rotates the release lever 30 and the push lever 32 attached to the sleeve 31 in integral with the release lever 30 in the counterclockwise direction; this push lever 32 thrusts the operation handle 17 and moves it to the chain-lined place; disengaging of the clutch means 3 is effected through the exactly same operation as mentioned above; and thus the retreat movement of the snow plow 1 is discontinued, whereby the operator can be protected from running over by the snow plow 1.

Next, supposing the operator dashed against the lower guard frame 36 (mainly, the transverse rod 38), the guard frame 36 oscillates in the counterclockwise direction and shifts up to the place illustrated in FIG. 3 with a chain line, whereby the shift of the operation handle 17 and the accompanying disengagement of the clutch means 3 are effected by the aid of the chain 40 as well as the connecting rod 29, release lever 30 and push lever 32 likewise in the case of the guard frame 26 so as to stop the snow plow 1.

Although a particular preferred embodiment of this invention has been disclosed in detail for illustrative purposes, it will be recognized that variations or modifications of the disclosed apparatus, including the rearrangement of parts, lie within the scope of this invention.

What is claimed is:

1. A snow plow including an automotive car body equipped with an engine, a transmission and a clutch means; an operation frame attached to the rear upper portion of said car body; a clutch operation means attached to said operation frame, said clutch operation means being designed to operate for engaging or disengaging said clutch means; and a snow plow apparatus mounted on the car body, wherein said operation frame is provided with an upper guard frame having a substantially same width as the car body with freedom of oscillation; the car body is provided, under said upper guard frame, with a lower guard frame having a substantially same width as the car body with freedom of oscillation; said both guard frames are connected by means of a first connecting means; and any one of both guard frames is connected with the clutch operation means by means of a second connecting means so that when an impact is applied on either guard frame the clutch operation means is designed to operate for disengaging the clutch means.

2. The snow plow aparatus according to claim 1 wherein said first connecting means comprises any of chain, rope, wire and rod.

3. The snow plow apparatus according to claim 1 or claim 2 wherein said second connecting means comprises a rod and functions to connect the lower part of the upper guard frame with another end of a lever, one end of said lever being fixed on a horizontal rotary shaft of said clutch operation means.

* * * * *